US006287640B1

(12) United States Patent
McClain et al.

(10) Patent No.: US 6,287,640 B1
(45) **Date of Patent: *Sep. 11, 2001**

(54) SURFACE TREATMENT OF SUBSTRATES WITH COMPOUNDS THAT BIND THERETO

(75) Inventors: James B. McClain, Raleigh; James P. DeYoung, Durham; Timothy J. Romack, Greenville, all of NC (US)

(73) Assignee: MiCell Technologies, Inc., Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/561,413

(22) Filed: Apr. 28, 2000

Related U.S. Application Data

(63) Continuation-in-part of application No. 09/527,193, filed on Mar. 17, 2000, now Pat. No. 6,165,560, which is a continuation of application No. 09/479,566, filed on Jan. 7, 2000, now Pat. No. 6,187,383, which is a continuation of application No. 09/090,330, filed on May 29, 1998, now Pat. No. 6,030,663, which is a continuation-in-part of application No. 08/866,348, filed on May 30, 1997, now abandoned.

(51) Int. Cl.[7] ..... B05D 1/00; B05D 7/14

(52) U.S. Cl. ..... 427/388.1; 427/389.9; 427/393.4; 427/394; 427/435; 427/439

(58) Field of Search ..... 427/389.9, 393.4, 427/388.1, 439, 435, 394

(56) References Cited

U.S. PATENT DOCUMENTS

| | | | |
|---|---|---|---|
| 2,841,573 | 7/1958 | Ahlbrecht et al. | 260/79.3 |
| 3,282,905 | 11/1966 | Fasick et al. | 260/89.5 |
| 3,497,375 | 2/1970 | Rundle et al. | 117/5.1 |
| 3,811,933 | 5/1974 | Uffner et al. | 117/155 |
| 4,107,055 | 8/1978 | Sukornick et al. | 252/8.6 |
| 4,147,851 | 4/1979 | Raynolds | 526/245 |
| 4,539,006 | 9/1985 | Langford | 8/94.1 |
| 4,582,731 | 4/1986 | Smith | 427/421 |
| 4,734,227 | 3/1988 | Smith | 264/13 |
| 4,923,720 | 5/1990 | Lee et al. | 427/422 |
| 4,992,308 | 2/1991 | Sunol | 427/297 |
| 5,057,577 | 10/1991 | Matsuo et al. | 525/276 |
| 5,108,799 | 4/1992 | Hoy et al. | 427/422 |
| 5,149,753 | 9/1992 | Inukai et al. | 526/245 |
| 5,169,687 | 12/1992 | Sunol | 427/297 |
| 5,197,800 | 3/1993 | Saidman et al. | 366/136 |
| 5,199,956 | 4/1993 | Schlenker et al. | 8/473 |
| 5,211,342 | 5/1993 | Hoy et al. | 239/707 |
| 5,212,229 | 5/1993 | Taylor et al. | 524/556 |
| 5,250,078 | 10/1993 | Saus et al. | 8/475 |
| 5,269,815 | 12/1993 | Schlenker et al. | 8/475 |
| 5,290,602 | 3/1994 | Argyropoulos et al. | 427/421 |
| 5,298,032 | 3/1994 | Schlenker et al. | 8/475 |
| 5,308,648 | 5/1994 | Prince et al. | 427/212 |
| 5,326,823 | 7/1994 | Rolando et al. | 525/276 |
| 5,330,783 | 7/1994 | Saidman et al. | 427/8 |
| 5,340,614 | 8/1994 | Perman et al. | 427/2.24 |
| 5,350,795 | 9/1994 | Smith et al. | 524/507 |
| 5,362,519 | 11/1994 | Argyropoulos et al. | 427/385.5 |
| 5,407,132 | 4/1995 | Messerly et al. | 239/124 |
| 5,407,267 | 4/1995 | Davis et al. | 366/152 |
| 5,415,897 | 5/1995 | Chang et al. | 427/421 |
| 5,496,901 | 3/1996 | DeSimone | 526/89 |
| 5,508,060 | 4/1996 | Perman et al. | 427/2.14 |
| 5,512,058 | 4/1996 | Gavend et al. | 8/94.18 |
| 5,530,049 | 6/1996 | Dee et al. | 524/424 |
| 5,602,225 | 2/1997 | Montagna et al. | 528/25 |
| 5,676,705 | 10/1997 | Jureller et al. | 8/142 |
| 5,683,473 | 11/1997 | Jureller et al. | 8/142 |
| 5,683,977 | 11/1997 | Jureller et al. | 510/286 |

FOREIGN PATENT DOCUMENTS

| | | |
|---|---|---|
| 3904514 A | 8/1990 | (DE) . |
| 3906724 A | 9/1990 | (DE) . |
| 3906737 A | 9/1990 | (DE) . |
| 4332219 A | 3/1994 | (DE) . |
| 42 39 214 A1 | 5/1994 | (DE) . |
| 4429470 A | 3/1995 | (DE) . |
| 4333221 A | 4/1995 | (DE) . |
| 4336941 A | 5/1995 | (DE) . |
| 4344021 A | 6/1995 | (DE) . |
| 4404839 A | 8/1995 | (DE) . |
| 492535 | 7/1992 | (EP) . |
| 0506 067 A1 | 9/1992 | (EP) . |
| WO 93/14255 | 7/1993 | (WO) . |
| WO 93/14259 A | 7/1993 | (WO) . |
| WO 97/16264 | 5/1997 | (WO) . |
| WO 98/11293 | 3/1998 | (WO) . |

OTHER PUBLICATIONS

Rao et al., Textile Finishes and Fluorosurfactants, *Organofluorine Chemistry: Principles and Commercial Applications,* Banks et al. (eds), Plenum Press, New York, pp. 321–338 (1994).

Bowman et al., Sizing and Desizing Polyester/Cotton Blend Yarns Using Liquid Carbon Dioxide, *Textile Res. J.,* 66 (12):795–802 (1996).

DeSimone et al., Synthesis of Fluoropolymers in Supercritical Carbon Dioxide, *Science,* 257:945–947 (1992).

AATCC's 1997 Int'l Conference & Exhibition; XP–000722163, Speaker—Joseph M. DeSimone, Surfactants for Liquid and Supercritical Carbon Dioxide, *Textile Chemist and Colorist,* 29(8):28,30 (Aug. 1997).

International Search Report for PCT/US98/10897, dated Apr. 19, 1998.

*Primary Examiner*—Erma Cameron
(74) *Attorney, Agent, or Firm*—Myers Bigel Sibley & Sajovec

(57) ABSTRACT

A method of treating a substrate comprises contacting a surface of said substrate with a pressurized fluid comprising carbon dioxide and a surface treatment component, the surface treatment component being one which binds to the substrate. The contacting step is preferably carried out by immersion, the fluid is preferably a liquid or supercritical fluid, the substrate is preferably a metal or fabric substrate, and the surface treatment component is preferably a fluoroacrylate polymer.

43 Claims, No Drawings

SURFACE TREATMENT OF SUBSTRATES WITH COMPOUNDS THAT BIND THERETO

RELATED APPLICATIONS

This application is a continuation-in-part of application Ser. No. 09/527,193 Filed: Mar. 17, 2000, now U.S. Pat. No. 6,165,560 which is in turn a continuation of patent application Ser. No. 09/479,566, filed Jan. 7, 2000, now U.S. Pat. No. 6,187,383 B1 which is in turn a continuation of patent application Ser. No. 09/090,330, filed May 29, 1998, now issued as U.S. Pat. No. 6,030,663, which is in turn a continuation-in-part of application Ser. No. 08/866,348, filed May 30, 1997, now abandoned, the disclosures of all of which are incorporated by reference herein in their entirety.

FIELD OF THE INVENTION

The invention relates to treating surfaces of substrates. More particularly, the invention relates to treating the surfaces using a carbon dioxide fluid. The method is particularly useful for imparting stain resistance to fabrics.

BACKGROUND OF THE INVENTION

In a number of industrial applications, it is often desirable to treat the surface of an article or substrate in order to protect the substrate from contaminants. This typically includes controlling and enhancing the barrier properties of a surface to, for example, oils, grease, lipophilic materials, water, hydrophilic solutions, and dirt. Examples of such applications include SCOTCH GUARD® and STAIN MASTER® surface coating materials for textile articles such as furniture, clothing, and carpets to impart resistance to staining, and also treating articles formed from metal such as precision parts. It is often desirable to apply a surface treatment to an article in order to protect an article from foreign matter while also preserving the desirable physical properties of the article. With respect to textile-related articles for example, it is particularly desirable to maintain aesthetic properties relating to hand, drape, and texture.

For the most part, organic solvents such as hydrocarbons, chlorinated solvents, and chlorofluorocarbons (CFCs) have been employed in treating various substrates. Recently, however, the use of these solvents has been increasingly disfavored due to heightened environmental concerns. As one alternative, aqueous-based systems have been proposed for treating various articles. The use of the aqueous-based systems, however, also suffers from possible drawbacks. For example, contacting an article with water often adversely affects the physical properties of the article. For example, the texture and drape of a textile can be negatively impacted, or flash rusting of metal parts may occur due to water contact. Additionally, many low surface energy materials are largely insoluble in water, and must be formulated into emulsions or suspensions (an inherent disadvantage of aqueous systems). Moreover, water of suitable quality for use in coating and impregnation is becoming less available and more expensive.

$CO_2$-based dry cleaning systems that contain surfactant molecules (particularly molecules having a $CO_2$-philic group are described in, for example, U.S. Pat. Nos. 5,683,473; 5,676,705; and 5,683,977, all to Jureller. The purpose of the surfactant molecule proposed in the Jureller patents is to carry away soil from the fabrics, rather than to become deposited upon, and seal soil to, the fabric. Surface treatment is, accordingly, neither suggested nor disclosed.

In view of the above, it is an object of the present invention to provide a method of treating and/or impregnating a substrate which does not require the use of organic solvents or water.

It is also an object of the present invention to provide a method of impregnating a substrate which minimizes adverse affects to the physical properties of the substrate.

SUMMARY OF THE INVENTION

In one aspect, the invention provides a method of treating a substrate. The method comprises contacting, preferably by immersing, a surface of the substrate with a pressurized fluid comprising carbon dioxide and a surface treatment component. The surface treatment component is entrained in the pressurized fluid and contacts the surface so that the surface treatment component lowers the surface tension of the surface of the substrate and treats the substrate. Surface treatment components comprising fluoroacrylate polymers (including copolymers thereof) are preferred. The fluid is preferably a liquid or supercritical fluid.

In a preferred embodiment of the present invention, the surface treatment component contains a functional group that binds, e.g. covalently binds, to the substrate.

In another aspect, the invention provides a method of imparting stain resistance to a fabric. The method comprises immersing the fabric in a pressurized fluid containing carbon dioxide and a surface treatment component. The surface treatment component is entrained in the pressurized fluid and contacts the fabric to lower the surface tension of the fabric. The surface treatment component is deposited on the fabric, and the carbon dioxide separated from the fabric so that the surface treatment component remains deposited on the fabric, thus rendering the fabric stain resistant.

DETAILED DESCRIPTION OF THE INVENTION

The invention will now be further described by the preferred embodiments presented herein. It should be understood however that the embodiments are to be interpreted as being illustrative of the invention and not as limiting the invention.

The invention relates to a method of treating a substrate in a pressurized system. The method includes the step of contacting a surface of the substrate with a fluid comprising carbon dioxide and a surface treatment component. The surface treatment component is entrained in the fluid and contacts the surface so that the surface treatment component lowers the surface tension of the substrate. In this instance, the "entrainment of the surface treatment component in the fluid" refers to a surface treatment component which may be solubilized, dissolved, emulsified, or dispersed in the bulk fluid during transport of the fluid to the substrate surface and also upon the interaction of the fluid with the substrate surface. Entrainment may also include surface treatment components which are insoluble in the carbon dioxide containing fluid but which may be physically dispersed in the fluid with or without the aid or a dispersing agent or the like. For the purposes of the invention, the term "lowers the surface tension" can be understood as reducing the surface tension of the substrate to the extent such that in end use commercial applications contaminant materials (aqueous, organics, solids, liquids, etc.) exhibit a reduced tendency to adhere or absorb onto the substrate surface. For illustrative purposes, the invention is to be differentiated from processes in which surface treatments are applied in a transient manner for treating materials. Such an instance involves sizing of textile yarns as set forth in Bowman et al., *Textile Res. J.* 66 (12), 795–802 (1996), in which coating materials are applied to the yarns and then removed. In contrast to the claimed invention, properties imparted by the sizing would render the substrate unusable.

Moreover, the surface treatment component is entrained in the fluid upon contacting the substrate. Such a process is distinguishable from spraying applications in which a fluid containing a coating material is emitted from an apparatus and thereafter undergoes a phase change, and is propelled by the fluid to the substrate. The surface treatment component of the present invention is entrained in the pressurized fluid upon contacting the substrate.

As described above, the surface tension is lowered as a result of applying the surface treatment component. Preferably, the surface tension is lowered by a value of 10 percent, and more preferably the surface tension is lowered by a value of 25 percent. The level of reduction can be on the order of 1 dyne/sq cm.

The fluid employed in the method of the invention is pressurized fluid, which is defined to be greater than ambient, typically at least 20 bar. For the purposes of the invention, the fluid contains carbon dioxide in a liquid, gaseous, or supercritical phase. If liquid $CO_2$ is used, the temperature employed during the process is preferably below 31° C. If gaseous $CO_2$ is used, it is preferred that the phase be employed at high pressure. As used herein, the term "high pressure" generally refers to $CO_2$ having a pressure from about 20 to about 500 bar. With respect to $CO_2$, the pressure of the gas is typically greater than 20 bar and less than its critical pressure.

In the preferred embodiment, the $CO_2$ is utilized in a dense (i.e., "supercritical" or "liquid" or "compressed gas") phase. Such a phase typically employs $CO_2$ at a density greater than the critical density, typically greater than 0.5 g/cc. As used herein, "supercritical" means that a fluid medium is at a temperature that is sufficiently high that it cannot be liquefied by pressure. The thermodynamic properties of $CO_2$ are reported in Hyatt, *J. Org. Chem.* 49: 5097–5101 (1984); therein, it is stated that the critical temperature of $CO_2$ is about 31° C. For the purposes of the invention, the temperature and pressure conditions of the fluid are defined by the thermophysical properties of pure carbon dioxide.

The carbon dioxide containing fluid used in the process of the invention may be employed in a single (e.g., non-aqueous) or multi-phase system with appropriate and known liquid components. Such components generally include, but are not limited to, a co-solvent or modifier, a surfactant, a co-surfactant, and other additives such as bleaches, optical brighteners, enzymes, rheology modifiers, sequestering agents, chelants, biocides, antiviral agents, fungicides, acids, polishes, radical sources, plasma, deep UV (photoresist) materials, crosslinking agents (e.g., difunctional monomers), metal soaps, sizing agents, antistatics, antioxidants, UV stabilizers, whiteners, fabric softener builders, detergents, dispersants, hydrotropes, and mixtures thereof. Any or all of the components may be employed in the process of the present invention prior to, during, or after the substrate is contacted by the $CO_2$ fluid.

For the purposes of the invention, multi-phase systems refers to processes in which the substrate may be treated in the fluid that contains a solid or fluid phase other than a carbon dioxide fluid phase. Other components in such systems include, for example, the surface treatment component itself, water under carbon dioxide head pressure which may be instrumental in lowering the $T_g$ in of a substrate and, in certain instances, may be needed for chemical reasons; immiscible liquids; and head pressurizing gases, the selection of which is known in the art. Non-aqueous fluids are currently preferred, particularly for metal and fabric substrates.

Examples of suitable co-solvents or modifiers include, but are not limited to, liquid solutes such as alcohols (e.g., methanol, ethanol, and isopropanol); fluorinated and other halogenated solvents (e.g., chlorotrifluoromethane, trichlorofluoromethane, perfluoropropane, chlorodifluoromethane, and sulfur hexafluoride); amines (e.g., N-methyl pyrrolidone); amides (e.g., dimethyl acetamide); aromatic solvents (e.g., benzene, toluene, and xylenes); esters (e.g., ethyl acetate, dibasic esters, and lactate esters); ethers (e.g., diethyl ether, tetrahydrofuran, and glycol ethers); aliphatic hydrocarbons (e.g., methane, ethane, propane, ammonium butane, n-pentane, and hexanes); oxides (e.g., nitrous oxide); olefins (e.g., ethylene and propylene); natural hydrocarbons (e.g., isoprenes, terpenes, and d-limonene); ketones (e.g., acetone and methyl ethyl ketone); organosilicones; alkyl pyrrolidones (e.g., N-methyl pyrrolidone); paraffins (e.g., isoparaffin); petroleum-based solvents and solvent mixtures; and any other compatible solvent or mixture that is available and suitable. Mixtures of the above co-solvents may be used. The above components can be used prior to, during, or after the substrate is contacted by the $CO_2$ fluid.

A surfactant or co-surfactant may be used in the fluid in addition to the surface treatment component. Suitable surfactants or co-surfactants are those materials which typically modify the action of the surface treatment component, for example, to enhance contact of the surface treatment component with the substrate. Exemplary co-surfactants that may be used include, but are not limited to, longer chain alcohols (i.e., greater than $C_8$) such as octanol, decanol, dodecanol, cetyl, laurel, and the like; and species containing two or more alcohol groups or other hydrogen bonding functionalities; amides; amines; and other like components. Potentially surface active components which also may be employed as co-surfactants include, but are not limited to, fluorinated small molecules, fluorinated acrylate monomers (e.g., hydrogenated versions), fluorinated alcohols and acids, and the like. Suitable other types of materials that are useful as co-surfactants are well known by those skilled in the art, and may be employed in the process of the present invention. Mixtures of the above may be used.

Various surface treatment components may be used in the process of the present invention. A surface treatment component is a material which is entrained in the fluid so as to treat the surface of the substrate and lower the surface tension of the substrate as set forth herein.

The term "treat" refers to the coating or impregnating of the substrate or substrate surface with the surface treatment component, with the surface treatment component tenaciously or permanently adhering to the surface after removal from the fluid, so that it serves as a protective coating thereon for the useful life of the coated substrate (e.g., is able to withstand multiple wash cycles when the substrate is a fabric or garment; is able to withstand a corrosive environment when the substrate is a part such as a metal part), until the substrate is discarded or must be re-treated. If desired, the surface active component may polymerize on the surface, or may be grafted onto the surface. Suitable surface treatment components include, but are not limited to, various monomer and polymer materials. Exemplary monomers include those which may be reactive or nonreactive, and contain fluorinated groups, siloxane groups or mixtures thereof.

Polymers which are employed as surface treatment components may encompass those which contain a segment which has an affinity for carbon dioxide ("$CO_2$-philic") along with a segment which does not have an affinity for carbon dioxide ("$CO_2$-phobic") which may be covalently joined to the $CO_2$-philic segment. Reactive and non-reactive polymers may be used. Exemplary $CO_2$-philic segments may include a fluorine-containing segment, a siloxane-containing segment, or mixtures thereof.

The fluorine-containing segment is typically a "fluoropolymer". The term "fluoropolymer," as used herein, has its conventional meaning in the art. See generally *Fluoropolymers* (L. Wall, Ed. 1972)(Wiley-Interscience Division of John Wiley & Sons); see also *Fluorine-Containing Polymers*, 7 Encyclopedia of Polymer Science and Engineering 256 (H. Mark et al. Eds., 2d Ed. 1985). The term "fluoromonomer" refers to fluorinated precursor monomers which make up the fluoropolymers. Any suitable fluoromonomer may be used in forming the fluoropolymers, including, but not limited to, fluoroacrylate monomers, fluoroolefin monomers, fluorostyrene monomers, fluoroalkylene oxide monomers (e.g., perfluoropropylene oxide, perfluorocyclohexene oxide), fluorinated vinyl alkyl ether monomers, and the copolymers thereof with suitable comonomers, wherein the comonomers are fluorinated or unfluorinated.

Fluorostyrenes and fluorinated vinyl alkyl ether monomers which may be polymerized by the method of the present invention include, but are not limited to, αfluorostyrene; βfluorostyrene; α,β-difluorostyrene; β,β-difluorostyrene; αββfluorostyrene; α,trifluoromethylstyrene; 2,4,6Tris(trifluoromethyl)styrene; 2,3,4,5,6-pentafluorostyrene; 2,3,4,5,6-pentafluoro-α-methylstyrene; and 2,3,4,5,6-pentafluoro-β-methylstyrene.

Tetrafluoroethylene copolymers can be used and include, but are not limited to, tetrafluoroethylene-hexafluoropropylene copolymers, tetrafluoroethyleneperfluorovinyl ether copolymers (e.g., copolymers of tetrafluoroethylene with perfluoropropyl vinyl ether), tetrafluoroethylene-ethylene copolymers, and perfluorinated ionomers (e.g., perfluorosulfonate ionomers; perfluorocarboxylate ionomers). High-melting $CO_2$-insoluble fluropolymers may also be used.

Fluorocarbon elastomers (see, e.g., 7 Encyclopedia of Polymer Science & Engineering 257) are a group of amorphous fluoroolefin polymers which can be employed and include, but are not limited to, poly(vinylidene fluoride-co-hexafluoropropylene); poly(vinylidene fluoride-co-hexafluoropropylene-co-tetrafluoroethylene); poly [vinylidene fluoride-co-tetrafluoroethylene-co-perfluoro (methyl vinyl ether)]; poly[tetrafluoroethylene-co-perfluoro (methyl vinyl ether)]; poly(tetrafluoroethylene-co-propylene; and poly(vinylidene fluoride-co-chlorotrifluoroethylene).

The term "fluoroacrylate monomer," as used herein, refers to esters of acrylic acid ($H_2C{=}CHCOOH$) or methacrylic acid ($H_2C{=}CCH_3COOH$), where the esterifying group is a fluorinated group such as perfluoroalkyl. A specific group of fluoroacrylate monomers which are useful may be represented by formula (I):

$$H_2C{=}CR^1COO(CH_2)_nR^2 \quad (I)$$

wherein:

n is preferably from 1 to 3;

$R^1$ is hydrogen or methyl; and $R^2$ is a perfluorinated aliphatic or perfluorinated aromatic group, such as a perfluorinated linear or branched, saturated or unsaturated $C_1$ to $C_{10}$ alkyl, phenyl, or naphthyl.

In a particular embodiment of the invention, $R^2$ is a $C_1$ to $C_8$ perfluoroalkyl or $—CH_2NR^3SO_2R^4$, wherein $R^3$ is $C_1$–$C_2$ alkyl and $R^4$ is $C_1$ to $C_8$ perfluoroalkyl.

The term "perfluorinated," as used herein, means that all or essentially all hydrogen atoms on an organic group are replaced with fluorine.

Monomers illustrative of Formula (I) above, and their abbreviations as used herein, include the following:

2-(N-ethylperfluorooctanesulfonamido) ethyl acrylate ("EtFOSEA");

2-(N-ethylperflooctanesulfonamido) ethyl methacrylate ("EtFOSEMA");

2-(N-methylperfluorooctanesulfonamido) ethyl acrylate ("MeFOSEA");

2-(N-methylperflooctanesulfonamido) ethyl methacrylate ("MeFOSEMA");

1,1-Dihydroperfluorooctyl acrylate ("FOA");

1,1-Dihydroperfluorooctyl methacrylate ("FOMA");

1,1,2,2-tetrahydro perfluoroalkyl acrylates;

1,1,2,2-tetrahydro perfluoroalkyl methacrylates;

1,1,2,2,3,3-hexahydro perfluoroalkyl acrylates; and 1,1,2,2,3,3-hexahydro perfluoroalkyl methacrylates.

Fluoroplastics may also be used and include those materials which are and are not melt processable such as crystalline or high melting or amorphous fluoroplastics.

Exemplary siloxane-containing segments include alkyl, fluoroalkyl, chloroalkyl siloxanes such as, but not limited to, polydimethyl siloxanes, polydiphenyl siloxanes, and polytrifluoro propyl siloxanes, Copolymers of the above may be employed which includes various types of monomers. Mixtures of any of the above may be used.

Exemplary $CO_2$-phobic segments may comprise common lipophilic, oleophilic, and aromatic polymers, as well as oligomers formed from monomers such as ethylene, α-olefins, styrenics, acrylates, methacrylates, ethylene and propylene oxides, isobutylene, vinyl alcohols, acrylic acid, methacrylic acid, and vinyl pyrrolidone. The $CO_2$-phobic segment may also comprise molecular units containing various functional groups such as amides; esters; sulfones; sulfonamides; imides; thiols; alcohols; dienes; diols; acids such as carboxylic, sulfonic, and phosphoric; salts of various acids; ethers; ketones; cyanos; amines; quaternary ammonium salts; and thiozoles.

Surface treatment components which are suitable for the invention may be in the form of, for example, random, block (e.g., di-block, tri-block, or multi-block), blocky (those from step growth polymerization), and star homopolymers, tapered polymers, tapered block copolymers, gradient block copolymers, other copolymers, and co-oligomers. Exemplary surface treatment components include, but are not limited to, poly(1,1-Dihydroperfluorooctyl methacrylate) ("poly FOMA"); (1,1-Dihydroperfluorooctyl methacrylate)-co-methyl methacrylate ("FOMA-co-MMA"); (1,1-Dihydroperfluorooctyl methacrylate)-block-methyl methacrylate ("FOMA-block-MMA"); poly-1,1,2,2-tetrahydro perfluoroalkyl acrylate (PTA-N or TA-N); poly[1,1,2,2-tetrahydro perfluoroalkyl acrylate-co-poly(ethylene glycol) methacrylate] (TA-N/PEG); polydimethylsiloxanepolyethylene glycol (PDMS-PEG); poly(1,1,2,2-tetrahydro perfluoroalkyl acrylates); poly(1,1,2,2-tetrahydro perfluoroalkyl methacrylates); poly(1,1-dihydro perfluoroalkyl acrylates); poly(1,1-dihydro perfluoroalkyl methacrylates); poly(1,1,2,2,3,3-hexahydro perfluoroalkyl acrylates); and poly (1,1,2,2,3,3-hexahydro perfluoroalkyl methacrylates). For the purposes of the invention, two or more surface treatment components may be employed in the fluid containing carbon dioxide.

Other surface treatment components may be used which do not have distinct $CO_2$ philic and $CO_2$ phobic segments, e.g., perfluoropolymers. Exemplary surface treatment components which may be used include, but are not limited to, those described in Rao et al., *Textile Finishes and Fluorosurfactants, Organofluorine Chemistry: Principals and Commercial Applications*, Banks et al. (eds.) Plenum Press, New York (1994).

The surface treatment component may be applied in various amounts. In the instance where the component is applied as a low level surface treatment, it is preferred to employ the surface treatment component such that the weight of the substrate is less than about 5 percent of surface treatment component, and more preferably less than about 1 weight percent. In the instance where the surface treatment component is applied as a high level surface treatment, it is preferred that the surface treatment component is employed in amounts such that the weight of the substrate is greater than about 2 weight percent of surface treatment component.

Other additives may be employed with the carbon dioxide, preferably enhancing the physical or chemical properties of the fluid or acting on the substrate. Such additives may include, but are not limited to, bleaching agents, optical brighteners, bleach activators, corrosion inhibitors, enzymes, builders, co-builders, chelants, sequestering agents, and rheology modifiers. Mixtures of any of the above may be used. As an example, rheology modifiers are those components which may increase the viscosity of the fluid. Exemplary polymers include, for example, perfluoropolyethers, fluoroalkyl polyacrylics, and siloxane oils, including those which may be employed as rheology modifiers. Additionally, other molecules may be employed including $C_1$–$C_{10}$ alcohols, $C_1$–$C_{10}$ branched or straight-chained saturated or unsaturated hydrocarbons, ketones, carboxylic acids, N-methyl pyrrolidone, dimethylacetyamide, ethers, fluorocarbon solvents, and chlorofluorocarbon solvents. For the purposes of the invention, the additives are typically utilized up to their solubility limit during the contacting of the substrate.

Various substrates may be treated in the process of the invention. Such substrates include, but are not limited to, fabrics/textiles, porous and non-porous solid substrates such as metals (e.g., metal parts), glass, ceramics, synthetic and natural organic polymers, synthetic and natural inorganic polymers, other natural materials, and composite mixtures thereof. In particular, textile substrates are treated by the process, and encompass a larger number of materials. Such substrates are preferably knit, woven, or non-woven fabrics such as garments, upholstery, carpets, tents, clean room suits, parachutes, footwear, etc. formed from natural or synthetic fibers such as wool, cotton, silk, etc. Articles (e.g., ties, dresses, blouses, shirts, and the like) formed of silk or acetate are particularly well suited for treatment by the process of the invention.

The application of the surface treatment additive is advantageous with respect to medical devices, implants, and other articles of manufacture. The surface treatment component may be used in corrosive environments such as marine fishing equipment, for example.

In accordance with the invention, by virtue of the application of the surface treatment component, the surface tension is lowered such that contaminants exhibit reduced adherence or absorbency onto the substrate surface during, for example, commercial use. These contaminants are numerous and include, for example, water, inorganic compounds, organic compounds, polymers, particulate matter, and mixtures thereof.

In another aspect, the invention relates to a method of imparting stain resistance or stain release properties to a fabric. The method includes immersing the fabric in a fluid containing carbon dioxide and a surface treatment component. As defined herein, the surface treatment component is entrained in the fluid upon contacting the fabric to lower the surface tension of the fabric. The pressure of the fluid may then be decreased such that the surface treatment component treats the fabric and imparts stain resistance to the fabric. The term "decreasing the pressure of the fluid" refers to lowering the fluid to low pressure (e.g., ambient) conditions such that the surface treatment component is no longer dissolved in the fluid. It should be understood that it is not necessary to drive the surface treatment component onto the surface. For example, the chemistry of the surface treatment component may be possibly engineered such that it "bites" (e.g., bonds/binds) to the surface.

One desired aspect of a coating for a textiles or other substrates is durability throughout the use and exposure of the substrate to various cleaning methods. To this end, it is often desirable to create a chemical bond (a covalent bond) between the active coating material and the substrate. Alternatively, particularly in the case of aqueous emulsion applied textile repellant treatments, the active coating is formulated with other materials that form a resin on the substrate that essentially creates a net around the active repellant fixing it to the surface. For aqueous formulations these resin precursors are often aldehyde or urea-based condensation materials.

Some chemical functionalities that enable chemical bonding between a coating material and a substrate can not be used in water because of hydrolytic instability. Therefore, the ability to create a chemical bond between a coating material and a substrate can be limited by the use of aqueous emulsions. Since other solvents such as organic hydrocarbons and CFC's are also limiting, it can be difficult to apply repellant coatings to substrates so as to create chemical bonding between the substrate and the active material. Exemplary cases include isocyanate containing cross-linking agents, chlorosilane, alkoxysilane, and silanol containing materials. These chemical functionalities have limited stability when formulated in aqueous media. Other functionalities exemplary of this method that are stabile in aqueous formulations include epoxides, organic acids and esters, and amines.

Thus, coating components employed in the present invention can further comprise a functional group or substituent such as an isocyanate, chlorosilane, alkoxysilane, silanol, epoxide, acid, ester, or amide group. The particular functional group employed to form a covalent bond between the coating component and the substrate will depend, among other things, on the particular coating component and substrates involved. Numerous examples of suitable functional groups are known, including those described in U.S. Pat. No. 5,453,540, titled Isocyanate Derivatives Comprising Fluorochemical Oligomers (Describes the use of isocycantes in reaction with nucleophiles such as alcohols, amines, or thiols to generate stain repellent coatings that can be formulated and applied in aqueous emulsions); U.S. Pat. No. 4,788,287, titled High Performance Water and Oil Repellant (Discusses the use of various organic isocyanates to produce urethane containing fluorocarbon coatings); U.S. Pat. No. 5,442,011, titled Polymeric Fluorocarbon Siloxane, Emulsions and Surface Coatings Thereof (Discusses the hydrolysis of silicon halide or Si—O-alkyl linkages present on hydrocarbon and fluorocarbon radicals in the presence of water and other adjuncts that form a stable emulsion preventing polycondensation prior to the application of the materials to various substrates); U.S. Pat. No. 5,397,597, titled Optical Recording Medium and Method of Manufacturing the Same (Discusses the use of Silicon halide containing fluorocarbon radicals in the surface treatment of inorganic oxides producing polymeric nanolayer surface coatings); U.S. Pat. No. 3,639156, titled Siloxane Polymers for Soil-Repellant Soil and Soil-Release Textile Finishes (Describes the use of Fluorocarbon and Hydrocarbon alkylene oxide materials with pendant Si-halide groups or Si-alkoxide groups to generate polymeric coatings for textile substrates).

In an alternative embodiment, the surface treatment component may be deposited onto the surface of a substrate prior to the surface contacting the fluid containing carbon dioxide. Thereafter, the substrate is exposed to the fluid. This embodiment may be employed when using carbon dioxide insoluble but highly swellable surface treatment components.

The process of the invention may be used in conjunction with other steps, the selection of which are known in the art. For example, the process may be used simultaneously with or subsequent to a cleaning process which may remove contaminants from a substrate. Cleaning processes of this type include any technique relating to the application of a fluid or solvent to a substrate, with the fluid or solvent typically containing a surfactant and other cleaning or processing aids if desired. After the contaminant is removed from the surface, the surface treatment component may be applied to the substrate surface in accordance with the invention. Prior to using a cleaning process, it should be understood that a pre-treatment formulation may be applied to the substrate. Suitable pre-treatment formulations are those which may include solvents, chemical agents, additives, or mixtures thereof. The selection of a pre-treatment formulation often depends on the type of contaminant to be removed or substrate involved.

Operations subsequent to the treating of the substrate with the surface treatment component may also be performed, the operations of which are known by the skilled artisan. For example, the method may also include the step of washing the fabric with a suitable solvent subsequent to the treatment of the fabric with the surface treatment component. Other post-treatment (i.e., conditioning) steps may be carried out. For example, the substrate may be heated to set the surface treatment component. In an alternative embodiment, the substrate may be exposed to a reduced pressure. Also, the substrate may be exposed to a chemical modification such as being exposed to acid, base, UV light, and the like.

The process of the invention may be carried out using apparatus and techniques known to those skilled in the art. The process typically begins by providing a substrate in an appropriate pressurized system (e.g., vessel) such as, for example, a batchwise or semi-continuous system. The surface treatment component is also usually added to the vessel at this time. A fluid containing carbon dioxide is then typically added to the vessel and the vessel is heated and pressurized. The surface treatment component and the fluid may be added to the vessel simultaneously, if so desired. Additives (e.g., co-solvents, co-surfactants, and the like) may be added at an appropriate time.

After charging the vessel with the fluid containing carbon dioxide, the fluid contacts the substrate and the surface treatment component treats the substrate. During this time, the vessel is preferably agitated by known techniques including, for example, mechanical agitation; sonic, gas, or liquid jet agitation; pressure pulsing; or any other suitable mixing technique.

Care must be taken to insure that the treatment component is in fact deposited on the substrate, rather than carried away from the substrate as in a cleaning system. In general, four different techniques for depositing the treatment component, or coating material, onto the substrate, can be employed. In each, the coating is preferably initially provided in the fluid as a stable solution, suspension or dispersion, for subsequent deposition on the substrate. Most preferably the formulation of fluid and surface treatment component is homogeneous (e.g., optically clear) at initiation of the contacting step, particularly for fabric substrates, but this is not as essential for metal substrates were impregnation of the substrate is not an issue:

(A) The coating is dissolved or solubilized in the fluid at a given temperature and pressure, followed by contacting the fluid to the substrate and reduction of fluid pressure. This effects a lowering of the fluid density below a critical level, thus depositing the coating onto the substrate. The system pressure may be lowered by any suitable means, depending upon the particular equipment employed.

(B) The coating is deposited onto a substrate by contacting a fluid containing the coating to the substrate, and then diluting the fluid to a point that destabilizes the coating in the fluid resulting in deposition of the coating onto the substrate.

(C) The coating-containing fluid is contacted to the substrate at sub-ambient temperature and a given pressure, followed by increasing the temperature of the fluid to a point at which the coating destabilizes in the fluid and the coating is deposited onto the substrate.

(D) The coating is provided in the fluid at a sub-ambient temperature in a high pressure vessel, then metered into a second high pressure vessel containing a substrate and the fluid at a temperature sufficiently hither to destabilize the metered fluid and cause the deposition of the coating onto the substrate.

In all of the foregoing, the depositing step is followed by separating the carbon dioxide fluid from the substrate by any suitable means, such as by pumping or venting the fluid from the vessel containing the substrate after the deposition step. As will be appreciated, it is not necessary that all, or even a major portion of, the surface treatment component be deposited from the fluid onto the substrate, so long as a sufficient quantity is deposited to achieve the desired coating effect on the substrate after it is separated from the fluid.

The following examples are provided to illustrate the present invention, and should not be construed as limiting thereof.

EXAMPLE 1

A water a stain-repellant coating is synthesized by free-radical copolymerization of a fluoroalkyl-containing acrylic monomer, a hydrocarbon acrylic monomer, and a,a-Dimethyl meta-isopropenyl benzyl isocyanate in a weight ratio of 14:7:1. The resulting copolymer is then entrained in liquid carbon dioxide and applied to a garment constructed from wool. After the application the garment is heated to accelerate the formation of chemical bonds between the polymer and the wool fiber through condensation of the isocyanate groups of the polymer with (—OH) hydroxyl group of the wool to form urethane linkages. The resulting garment has durable water and stain resistance.

EXAMPLE 2

A surface-active fluoroalkyl containing material with chlorosilane functionality ($R_f$—$CH_2CH_2$—$SiCl_3$) is applied to a hard surface containing inorganic oxides ($SiO_2$, $TiO_2$, $Al_2O_3$) by first entraining the material in liquid CO2 and then exposing the substrate to the fluid. Covalent bonds are formed through the dehydrochlorination reaction of —SiCl groups on the surface-active material with —OH groups present at the surface of the metal oxides. The durable coating now provides increased oxidative stability, increased lubricity, and reduced moisture permeability. Such coatings can be generated on a variety of devices including but not limited to optical recording devices, functional ceramic components, moisture sensitive electronic components, glass and quartz materials, and metal oxide superconductors.

EXAMPLE 3

A stain and soil repellant material is synthesized by condensation polymerization of two monomer types. The first (1) contains an aliphatic fluorocarbon group (Rf) linked to a silicon atom bonded to one, two or three halogen atoms or alkoxy radicals by an organic linking group such as an ether or ester group, alkyl group, imido, or sulfonimide. The second monomer (2) contains repetitive alkylene oxy groups capped on one end with an alkyl group and linked on the other end to a silicon atom that contains one or more bonded halogen or alkoxy radicals. The linking group is as described in the first monomer. The condensation reaction is initiated by the hydrolysis reaction of the Si—X groups in the presence of water (X=halogen or —O-alkyl). The resulting material ideally contains residual non-hydrolyzed Si—X groups enabling subsequent bond formation with a substrate. Storage or delivery of the resulting material in water would eventually lead to complete hydrolysis of the active groups and may cause complete condensation polymerization prior to the application to the substrate. This would in turn limit the durability of the applied material on the substrate. In the current invention the partially hydrolyzed and condensed polymer is entrained in liquid CO2 and deposited on silk fabric. The fabric is then heated to facilitate subsequent condensation of active sites and reaction with naturally occurring hydroxyl (—OH) groups on the silk. The resulting fabric shows improved soil repellency and release properties along with improved lubricity and durability.

The foregoing is illustrative of the present invention and is not to be construed as limiting thereof. The invention is defined by the following claims, with equivalents of the claims to be included therein.

That which is claimed is:

1. A method of treating a substrate, said method comprising:

immersing a surface of said substrate with a pressurized liquid or supercritical fluid comprising carbon dioxide and a surface treatment component, said surface treatment component being entrained in said pressurized fluid and contacting said surface in an entrained condition so that said surface treatment component lowers the surface tension of the surface of said substrate and adheres to the substrate after removal of the substrate from the fluid to thereby treat said substrate;

and wherein said surface treatment component binds to said substrate.

2. The method according to claim 1, wherein said immersing step is followed by the step of removing said surface of said substrate from said fluid.

3. The method according to claim 1, wherein said carbon dioxide is present in a supercritical state.

4. The method according to claim 1, wherein said carbon dioxide is present in a liquid state.

5. The method according to claim 1, wherein said surface treatment component comprises a $CO_2$-philic segment.

6. The method according to claim 5, wherein said $CO_2$-philic segment comprises at least one monomer selected from the group consisting of fluorine-containing segments, siloxane-containing segments, and mixtures thereof.

7. The method according to claim 1, wherein said surface treatment component comprises a $CO_2$-phobic segment.

8. The method according to claim 7, wherein said $CO_2$-phobic segment is selected from the group consisting of lipophilic polymers, oleophilic polymers, aromatic polymers, and mixtures thereof.

9. The method according to claim 1, wherein said surface treatment component comprises a fluoroacrylate polymer.

10. The method according to claim 1, wherein said substrate is a metal substrate.

11. The method according to claim 1, wherein said substrate is a fabric substrate.

12. The method according to claim 1, wherein said pressurized fluid has a pressure greater than about 20 bar.

13. A method of treating a substrate, said method comprising:

contacting a surface of said substrate with a pressurized fluid comprising carbon dioxide and a surface treatment component, said surface treatment component being entrained in said pressurized fluid and contacting said surface in an entrained condition so that said surface treatment component lowers the surface tension of the surface of said substrate and treats said substrate, said surface treatment component becoming grafted onto the surface of the substrate;

and wherein said surface treatment component binds to said substrate.

14. The method according to claim 13, wherein said carbon dioxide is present in a supercritical state.

15. The method according to claim 13, wherein said carbon dioxide is present in a liquid state.

16. The method according to claim 13, wherein said surface treatment component comprises a $CO_2$-philic segment.

17. The method according to claim 16, wherein said $CO_2$-philic segment comprises at least one monomer selected from the group consisting of fluorine-containing segments, siloxane-containing segments, and mixtures thereof.

18. The method according to claim 13, wherein said surface treatment component comprises a $CO_2$-phobic segment.

19. The method according to claim 18, wherein said $CO_2$-phobic segment is selected from the group consisting of lipophilic polymers, oleophilic polymers, aromatic polymers, and mixtures thereof.

20. The method according to claim 13, wherein said surface treatment component is a fluoroacrylate.

21. The method according to claim 13, wherein said substrate is a metal substrate.

22. The method according to claim 13, wherein said substrate is a fabric substrate.

23. A method of imparting stain resistance to a fabric, said method comprising:

immersing said fabric in a pressurized fluid containing carbon dioxide and a surface treatment component, said surface treatment component being entrained in said pressurized fluid and contacting said fabric in an entrained condition to lower the surface tension of said fabric; then depositing said surface treatment component on said fabric; and then separating said carbon dioxide from said fabric so that said surface treatment component remains deposited on said fabric;

and wherein said surface treatment component binds to said fabric.

24. A method according to claim 23, wherein said depositing step is carried out by lowering the pressure of said fluid.

25. A method according to claim 23, wherein said depositing step is carried out by diluting said fluid.

26. A method according to claim 23, wherein said depositing step is carried out by raising the temperature of said fluid.

27. A method according to claim 23, wherein said fluid is a non-aqueous fluid.

28. The method according to claim 23, wherein said surface treatment component imparts stain resistance properties to said fabric.

29. The method according to claim 23, wherein said surface treatment component imparts stain release properties to said fabric.

30. A method of imparting stain and water resistance to a textile fabric, said method comprising:

immersing said textile fabric in a pressurized liquid containing carbon dioxide and a surface treatment component; then depositing said surface treatment component on said textile fabric; and then separating said carbon dioxide from said textile fabric so that said surface treatment component remains deposited on said textile fabric;

wherein said surface treatment component comprises a $CO_2$-philic segment, and wherein said $CO_2$-philic segment is selected from the group consisting of fluorine-containing segments, siloxane-containing segments, and mixtures thereof;

and wherein said surface treatment component binds to said textile fabric.

31. A method according to claim 30, wherein said depositing step is carried out by lowering the pressure of said liquid.

32. A method according to claim 30, wherein said depositing step is carried out by diluting said liquid.

33. A method according to claim 30, wherein said depositing step is carried out by raising the temperature of said liquid.

34. A method according to claim 30, wherein said liquid is a non-aqueous liquid.

35. The method according to claim 30, wherein said surface treatment component imparts stain release properties to said fabric.

36. The method according to claim 30, wherein said fabric comprises a carpet.

37. The method according to claim 30, wherein said fabric comprises a garment.

38. The method according to claim 37, wherein said garment is formed of silk or acetate.

39. The method according to claim 37, wherein said garment is selected from the group consisting of ties, dresses, blouses and shirts.

40. The method according to claim 30, wherein said $CO_2$-philic segment is a fluorine-containing segment.

41. The method according to claim 30, wherein said fluorine-containing segment is a fluoropolymer.

42. The method according to claim 30, wherein said $CO_2$-philic segment is a siloxane-containing segment.

43. A method according to claim 30, wherein said fabric comprises upholstery.

* * * * *